US011539149B2

(12) United States Patent
Kobayashi et al.

(10) Patent No.: US 11,539,149 B2
(45) Date of Patent: Dec. 27, 2022

(54) TERMINAL BLOCK WITH A REMOVABLE BUSBAR ASSEMBLY

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Shingo Kobayashi, Mie (JP); Sunghyun Byun, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/298,732

(22) PCT Filed: Nov. 28, 2019

(86) PCT No.: PCT/JP2019/046650

§ 371 (c)(1),
(2) Date: Jun. 1, 2021

(87) PCT Pub. No.: WO2020/121834

PCT Pub. Date: Jun. 18, 2020

(65) Prior Publication Data

US 2022/0052466 A1 Feb. 17, 2022

(30) Foreign Application Priority Data

Dec. 14, 2018 (JP) ..... JP2018-234406

(51) Int. Cl.
*H01R 9/24* (2006.01)

(52) U.S. Cl.
CPC ..... *H01R 9/24* (2013.01); *H01R 2201/26* (2013.01)

(58) Field of Classification Search
CPC ..... H01R 9/24; H01R 43/24; H01R 13/405; H01R 504/2201; H01R 504/26; B29C 45/14639
See application file for complete search history.

(56) References Cited

U.S. PATENT DOCUMENTS 6,283,769 B1 * 9/2001 Asao ..... H01R 13/6658 439/74
7,268,300 B2 * 9/2007 Miyazaki ..... H01R 13/62905 174/138 R (Continued)

FOREIGN PATENT DOCUMENTS

JP 2013-045510 A 3/2013
JP 2018-116897 A 7/2018

OTHER PUBLICATIONS

International Search Report dated Jan. 7, 2020 for WO 2020/121834 A1 (4 pages).

*Primary Examiner* — Vanessa Girardi
(74) *Attorney, Agent, or Firm* — Venjuris, P.C.

(57) ABSTRACT

It is aimed to provider a terminal block capable of simplifying parts management. A terminal block 1 includes a busbar assembly 50 having busbars 51, 52 made of metal and a holding portion 53 for holding the busbars 51, 52 with tip parts 51*b*, 52*b* and base end parts 51*a*, 52*a* of the busbars 51, 52 exposed. The terminal block 1 also includes a housing 10 into which the base end parts 51*a*, 52*a* of the busbars 51, 52 are inserted and to which the holding portion 53 is fixed.

9 Claims, 6 Drawing Sheets

(56) References Cited

U.S. PATENT DOCUMENTS

| | | | | |
|---|---|---|---|---|
| 9,017,099 | B2 * | 4/2015 | Ikeda | H01R 13/521 439/559 |
| 9,647,372 | B2 | 5/2017 | Eckel | |
| 10,522,266 | B2 * | 12/2019 | Kuboshima | H02G 3/0437 |
| 10,673,178 | B1 * | 6/2020 | Nakashima | H01R 9/16 |
| 2004/0235328 | A1 | 11/2004 | Maegawa et al. | |
| 2011/0198121 | A1 | 8/2011 | Matsumoto et al. | |
| 2012/0329344 | A1 | 12/2012 | Jeon et al. | |
| 2014/0140763 | A1 | 5/2014 | Tsujii et al. | |
| 2017/0222351 | A1 | 8/2017 | Kamei | |

* cited by examiner

TERMINAL BLOCK WITH A REMOVABLE BUSBAR ASSEMBLY

CROSS REFERENCE TO RELATED APPLICATIONS

This application is a national phase of PCT application No. PCT/JP2019/046650, filed on 28 Nov. 2019, which claims priority from Japanese patent application No. 2018-234406, filed on 14 Dec. 2018, all of which are incorporated herein by reference.

TECHNICAL FIELD

The present invention relates to a terminal block.

BACKGROUND

Conventionally, a terminal block has been used in connecting two devices (e.g. an inverter and a motor) in a vehicle in some cases. The terminal block includes a terminal for electrically connecting two devices and a housing for holding the terminal, for example, as described in Patent Document 1. The housing is integrally formed to the terminal.

PRIOR ART DOCUMENT

Patent Document

Patent Document 1: JP 2016-522550 A

SUMMARY OF THE INVENTION

Problems to be Solved

Generally, in mounting a terminal block on a device such as an inverter, a tip part of a terminal is first inserted into a casing of the device through a mounting hole provided in the casing. Then, the mounting hole is covered from outside the casing by a housing and the housing is fixed to the casing on the outer periphery of the mounting hole by screws or the like. Thereafter, a tool is inserted through an opening provided in the casing and different from the mounting hole, and a device-side terminal and a tip part of the terminal of the terminal block are fastened and connected by a bolt and a nut inside the casing.

Devices such as inverters come in various types depending on a vehicle type, a vehicle grade and equipment mounted in a vehicle. Thus, the terminal block also comes in various shapes according to the type of the device. That is, many types of terminal blocks are necessary according to the shape of a mounting hole provided in a casing of a device to fix the terminal block, the position of a device-side terminal in the casing and the like. For example, even if the shapes of the mounting holes are the same, the connected positions of the device-side terminals and the terminals of the terminal blocks are often different. Therefore, there has been a problem that parts management is cumbersome since there are many terminal blocks different in type (shape).

The present invention was developed to solve the above problem and aims to provide a terminal block capable of simplifying parts management.

Means to Solve the Problem

A terminal block for solving the above connector is provided with a busbar assembly including a busbar made of metal and a holding portion for holding the busbar with a tip part and a base end part of the busbar exposed, and a housing, the base end part of the busbar being inserted into the housing, the holding portion being fixed to the housing.

According to this configuration, the housing to be fixed to a casing of a device and the busbar to be connected to the device inside the casing are separately formed. The busbar is fixed to the housing via the holding portion. For example, in a plurality of types of devices, mounting holes provided in casings of the devices to mount a terminal block have the same shape, but positions inside the casings where a tip part of a busbar and a device-side terminal are connected are different in some cases. In such cases, if the shape of the busbar of the busbar assembly is changed, the same housing can be used. Further, for example, if positions inside the casings where the tip part of the busbar and the device-side terminal are connected are same in the devices, but only the shapes of the mounting holes provided in the casings of the devices to mount the terminal block are different, the same busbar assembly can be used if the shape of the housing is changed. Since various types of devices can be dealt with by combining a housing and a busbar assembly, the number of types of the housings and the busbar assemblies can be reduced as compared to the number of types of conventional terminal blocks in which a terminal and a housing are integrally formed. From these, parts management can be simplified.

Preferably, the busbar is made of a metal plate material.

According to this configuration, since the busbar is made of the metal plate material, processing is easy. This is preferable in terms of more easily forming the busbar into a desired shape according to the internal configuration of the device to be mounted with the terminal block.

Preferably, the busbar assembly includes two first and second busbars, and the holding portion holds the first and second busbars such that the first and second busbars are at a predetermined distance from each other.

According to this configuration, if the busbar assembly includes a plurality of busbars, the busbars can be held at a predetermined distance from each other by the holding portion. Thus, these busbars are easily handled even if the busbar assembly includes the plurality of busbars.

Preferably, the busbar assembly is detachably mountable to the housing because of the holding portion detachably mountable to the housing.

According to this configuration, the housing or busbar assembly is more easily replaced according to the configuration of the device. Note that "the holding portion detachably mountable to the housing" means that the holding portion can be detached from the housing. "The busbar assembly is detachably mountable to the housing" means that the busbar assembly can be detached from the housing by detaching the holding portion from the housing. The busbar assembly only has to be detachably mountable to the housing at least in a state before the terminal block is mounted on the casing of the device, and the busbar assembly may be completely fixed to the housing after the terminal block is mounted on the casing of the device.

Preferably, the housing includes a fixing portion to be fixed to the casing of the device and an insertion portion projecting from the fixing portion, the base end part of the busbar passed through the fixing portion being inserted into the insertion portion, and a tip of the busbar is located more on an outer peripheral side than the fixing portion when viewed from a direction parallel to the base end part of the busbar in the insertion portion.

According to this configuration, the tip of the busbar is located more on the outer peripheral side than the fixing portion to be fixed to the casing when viewed from the direction parallel to the base end part of the busbar in the insertion portion. Thus, the tip part of the busbar and the device-side terminal may not be connected in a range overlapping the fixing portion in the direction parallel to the base end part of the busbar in the insertion portion inside the casing. Since the position where the tip part of the busbar and the device-side terminal are connected can be set in a wide range outside the fixing portion when viewed from the direction parallel to the base end part of the busbar in the insertion portion inside the casing, a space required to connect the tip part of the busbar and the device-side terminal is more easily secured. Therefore, restrictions on parts in the device to secure the space required to connect the tip part of the busbar and the device-side terminal can be suppressed and a degree of freedom in designing the inside of the casing can be improved.

If the terminal block is mounted on the device, the housing is arranged with respect to the casing to cover the mounting hole provided in the casing to mount the terminal block from outside the casing. Thus, the fixing portion fixed to the casing is fixed to an outer peripheral part of the mounting hole in the casing and, hence, larger than the mounting hole. Therefore, the tip of the busbar located more on the outer peripheral side than the fixing portion when viewed from the direction parallel to the base end part of the busbar in the insertion portion is located more on the outer peripheral side than the mounting hole. The busbar assembly including the busbar is provided separately from the housing to be arranged with respect to the casing from outside the casing, and can be fixed to the housing from inside the casing. Thus, even if the tip of the busbar is located more on the outer peripheral side than the mounting hole when viewed from the direction parallel to the base end part of the busbar in the insertion portion, the terminal block can be mounted on the casing. Accordingly, regardless of the size of the mounting hole, the tip of the busbar can be set at a desired position. Therefore, a degree of freedom for the position of the tip of the busbar inside the casing can be enhanced since the tip of the busbar can be located more on the outer peripheral side than the mounting hole when viewed from the direction parallel to the base end part of the busbar in the insertion portion.

Preferably, the busbar assembly includes a positioning/fixing portion fixable to an in-device fixing portion provided inside a device to be mounted with the terminal block in a part of the busbar closer to a tip side than the holding portion.

According to this configuration, the position of the busbar in the casing is more easily determined by fixing the positioning/fixing portion to the in-device fixing portion. Therefore, a positional variation of the tip part of the busbar when the terminal block is mounted on the casing can be suppressed. Further, the vibration of the busbar inside the casing can be suppressed.

Preferably, the busbar assembly includes a connector fitting portion provided on the tip part of the busbar, an in-device connector provided on an end part of an in-device busbar or wire to be connected to the busbar being fittable into the connector fitting portion, and the busbar is electrically connected to the in-device busbar or wire via the in-device connector fit in the connector fitting portion.

According to this configuration, the in-device busbar or wire and the busbar are electrically connected by fitting the in-device connector into the connector fitting portion. Thus, the in-device busbar or wire and the busbar can be easily connected. Further, the in-device busbar or wire and the busbar can be connected even without using a tool. Note that if the busbar is made of a metal plate material, the connector fitting portion can be easily provided on the tip part of the busbar.

Effect of the Invention

According to the terminal block of the present invention, parts management can be simplified.

DETAILED DESCRIPTION TO EXECUTE THE INVENTION

Hereinafter, one embodiment of a terminal block is described.

Figure 1:
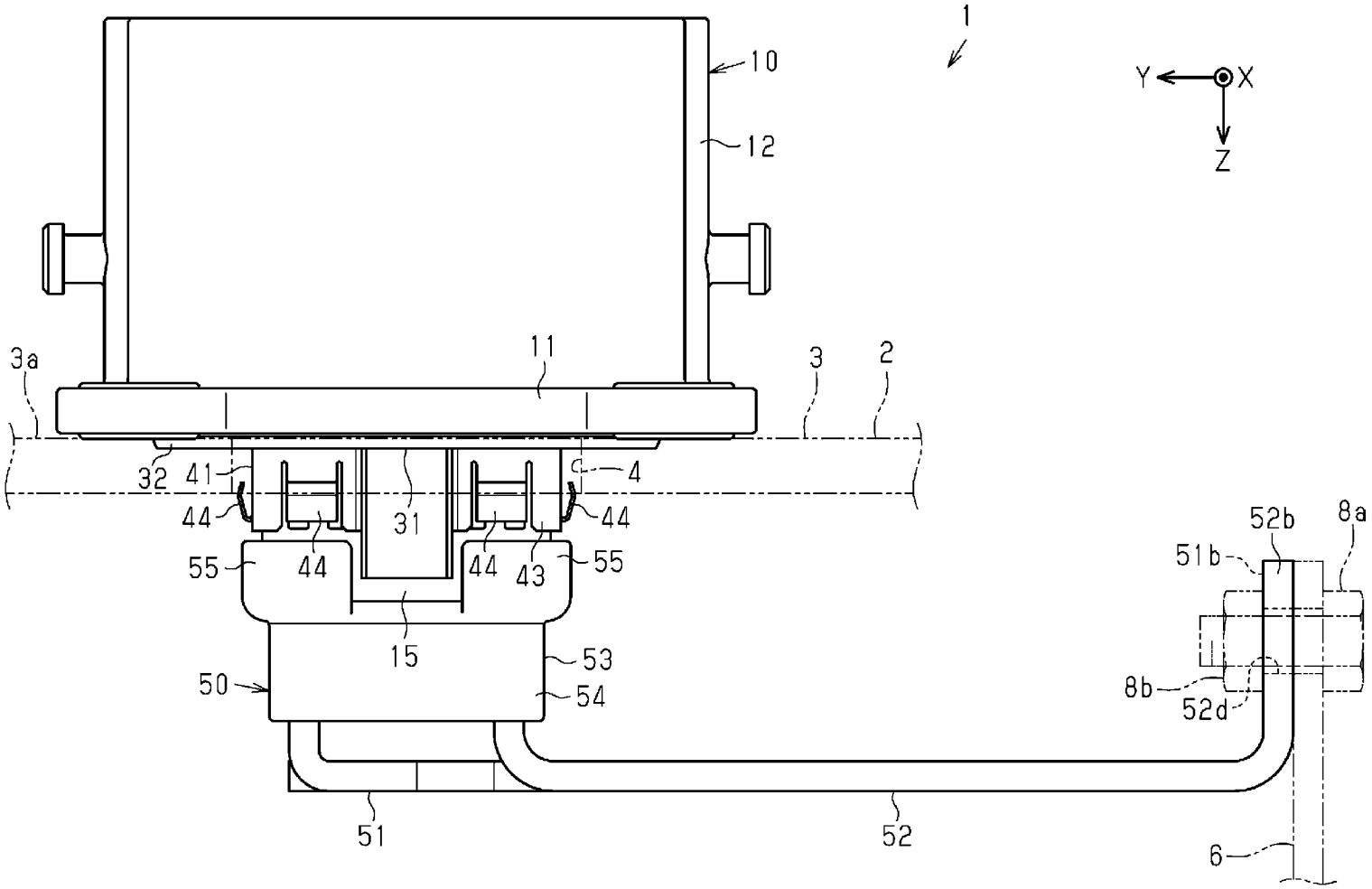
FIG. 1 is a front view of a terminal block in one embodiment.

The terminal block 1 of this embodiment shown in FIG. 1 is a terminal block for connecting a conductive path of a vehicle such as a hybrid vehicle, an electric vehicle or the like automotive vehicle, and is mounted on a casing 3 of a device 2 such as an inverter. The casing 3 is formed with a mounting hole 4 for mounting the terminal block 1. The mounting hole 4 penetrates through the casing 3 to allow communication between the inside and outside of the casing 3. The terminal block 1 can be arranged in an arbitrary orientation. In the following description, an X direction, a Y direction and a Z direction are referred to as a forward direction (direction toward a side forward of the plane of FIG. 1), a leftward direction and a downward direction.

The terminal block 1 includes a housing 10 to be fixed to the casing 3 and a busbar assembly 50 including a first busbar 51 and a second busbar 52 and to be fixed to the housing 10.

The housing 10 is made of an insulating resin material. The housing 10 includes a fixing portion 11 for fixing the housing 10 to the casing 3 and an insertion portion 12 projecting from the fixing portion 11.

Figure 3:
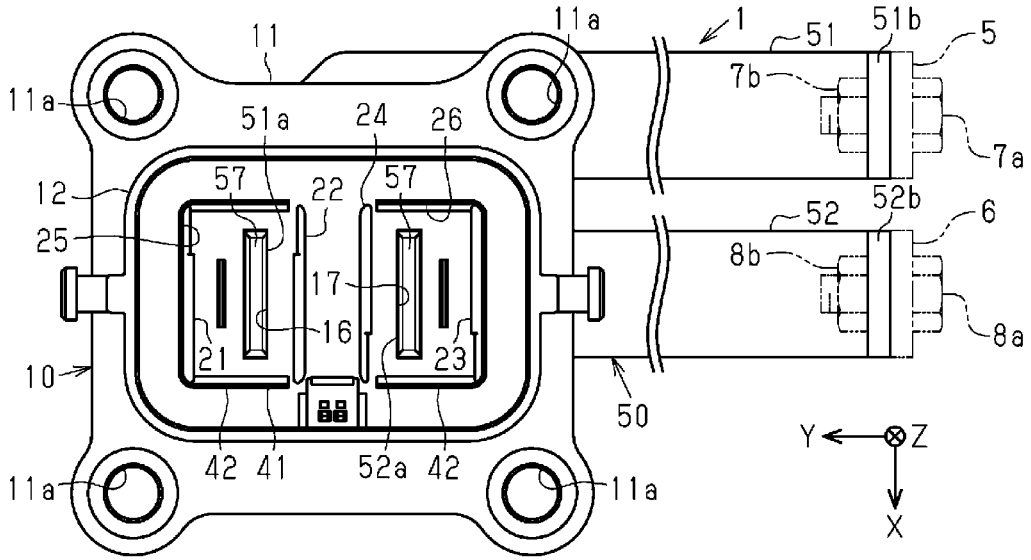
FIG. 3 is a plan view of the terminal block in the one embodiment.

As shown in FIGS. 1 and 3, the fixing portion 11 is substantially in the form of a rectangular flat plate. The fixing portion 11 has a larger outer shape (outer shape viewed in a thickness direction of the fixing portion 11 (same as a vertical direction)) than the mounting hole 4. Fastening holes 11*a* penetrating through the fixing portion 11 in the vertical direction are respectively formed on four corners of the fixing portion 11.

Figure 4:
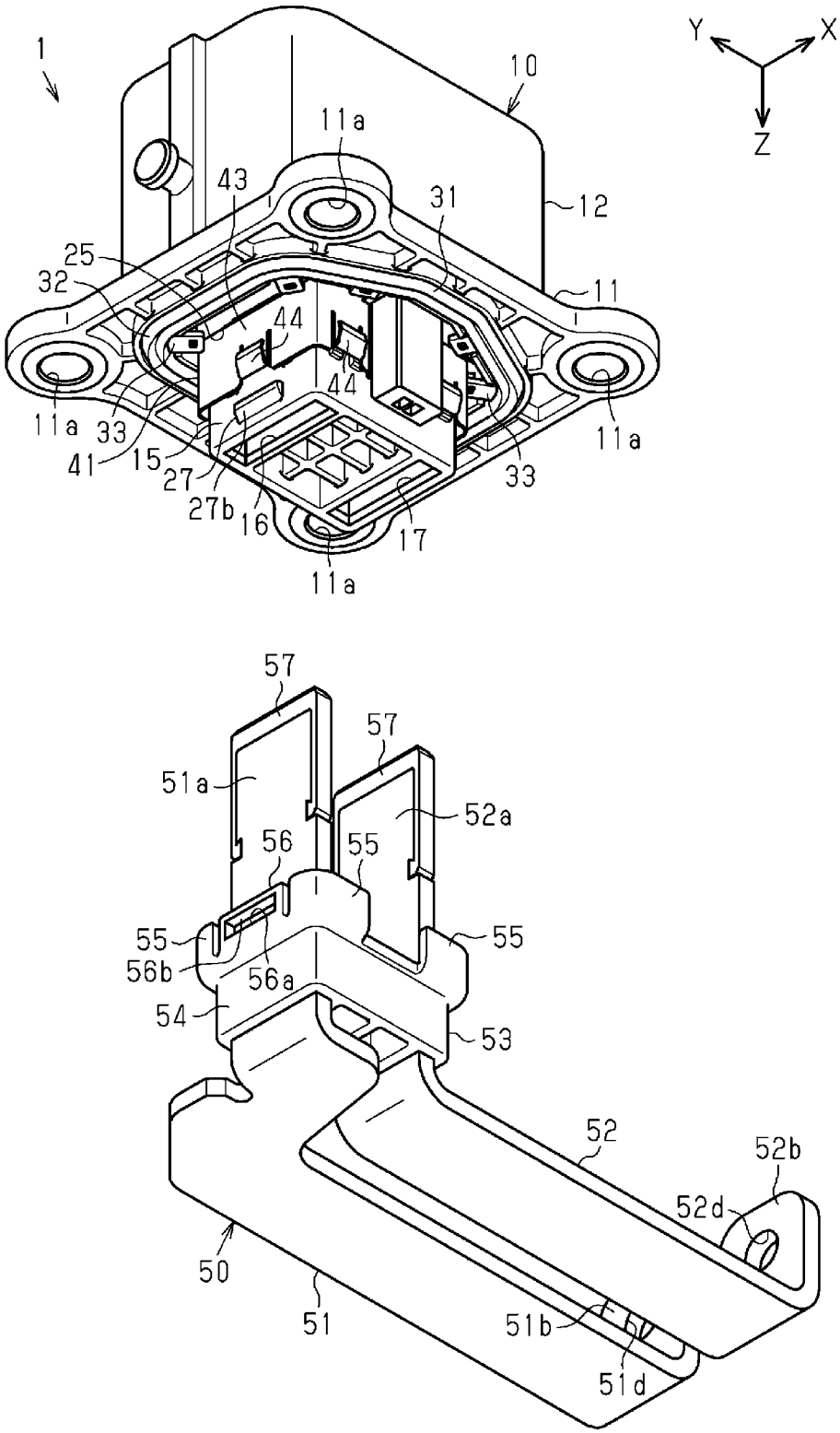
FIG. 4 is an exploded perspective view of the terminal block in the one embodiment.

As shown in FIGS. 1 and 4, an annular seal member 31 for sealing between the housing 3 (device 2) and the fixing portion 11 is mounted on an end part of the fixing portion 11 opposite to the insertion portion 12, i.e. on a lower end part. The seal member 31 is made of a resilient material such as rubber. The seal member 31 includes an annular seal body portion 32 larger than the mounting hole 4 and a plurality of seal fixing portions 33 projecting inward from the seal body portion 32. The seal member 31 is mounted on the fixing portion 11 by externally fitting the seal fixing portions 33 to a plurality of fixing pins (not shown) projecting from the lower end part of the fixing portion 11 inside the seal body portion 32.

Figure 2:
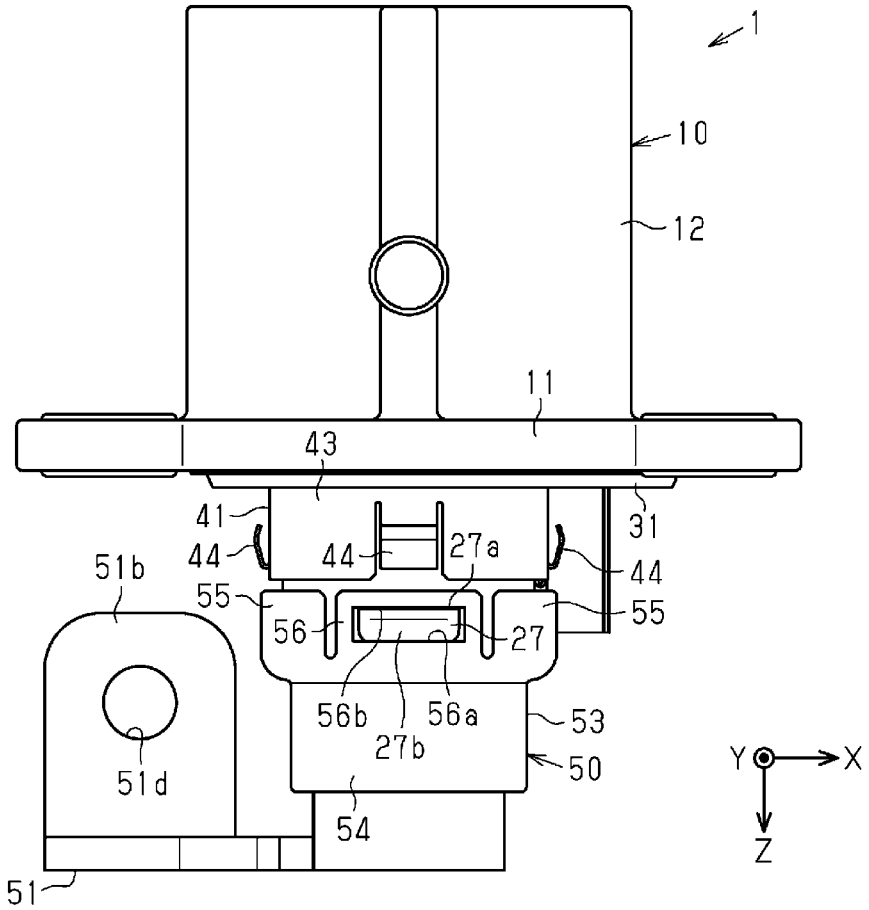
FIG. 2 is a side view of the terminal block in the one embodiment.

As shown in FIGS. 1 to 3, the insertion portion 12 is integrally formed to the fixing portion 11. The insertion portion 12 is in the form of a tube projecting upward (one side in the thickness direction of the fixing portion 11) from the fixing portion 11. In this embodiment, the insertion portion 12 is in the form of a tube having a rectangular shape with rounded corners when viewed from above.

Further, as shown in FIGS. 1, 2 and 4, the housing 10 includes an assembly supporting portion 15 projecting downward (i.e. toward a side opposite to the insertion portion 12) from the fixing portion 11. The assembly supporting portion 15 is integrally formed to the fixing portion 11. The assembly supporting portion 15 of this embodiment is substantially in the form of a rectangular parallelepiped. Both side surfaces in a lateral direction of the assembly supporting portion 15 are parallel to a front-rear direction and the vertical direction, and both side surfaces in the front-rear direction are parallel to the lateral direction and the vertical direction. The assembly supporting portion 15 is provided in a central part of the fixing portion 11 and has a smaller outer shape than the fixing portion 11 when viewed from the vertical direction.

Further, as shown in FIGS. 3 and 4, the housing 10 is formed with a first insertion hole 16 into which the first busbar 51 is to be inserted and a second insertion hole 17 into which the second busbar 52 is to be inserted. The first and second insertion holes 16, 17 penetrate through the fixing portion 11 and the assembly supporting portion 15 in the vertical direction. When the housing 10 is viewed from above (i.e. opening side of the insertion portion 12), upper openings of the first and second insertion holes 16, 17 are located inside the insertion portion 12. The first and second insertion holes 16, 17 are separated in the lateral direction and have a rectangular shape long in the front-rear direction when viewed from the vertical direction.

In the housing 10, insulation walls 21 to 24 are provided in a part on the upper surface of the fixing portion 11 and inside the insertion portion 12. The insulation walls 21, 22 rise up from the fixing portion 11 on both lateral sides of the upper end opening of the first insertion hole 16, and the insulation walls 23, 24 rise up from the fixing portion 11 on both lateral sides of the upper end opening of the second insertion hole 17.

The insulation wall 21 surrounds a left side of the upper end opening of the first insertion hole 16 and both sides in the front-rear direction of the upper end opening of the first insertion hole 16 and has a U shape open rightward when viewed from above. Parts of the insulation wall 21 located on the both sides in the front-rear direction of the upper end opening of the first insertion hole 16 are shorter in height (height from the upper surface of the fixing portion 11) than a part of the insulation wall 21 located on the left side of the upper end opening of the first insertion hole 16. Further, the insulation wall 22 located on a right side of the upper end opening of the first insertion hole 16 is in the form of a rectangular flat plate and surrounds the upper end opening of the first insertion hole 16 together with the insulation wall 21.

The insulation wall 23 surrounds a right side of the upper end opening of the second insertion hole 17 and both sides in the front-rear direction of the upper end opening of the second insertion hole 17 and has a U shape open leftward when viewed from above. Parts of the insulation wall 23 located on the both sides in the front-rear direction of the upper end opening of the second insertion hole 17 are shorter in height (height from the upper surface of the fixing portion 11) than a part of the insulation wall 23 located on the right side of the upper end opening of the second insertion hole 17. Further, the insulation wall 24 located on a left side of the upper end opening of the second insertion hole 17 is in the form of a rectangular flat plate and surrounds the upper end opening of the second insertion hole 17 together with the insulation wall 23.

Further, the fixing portion 11 is formed with a pair of shield insertion holes 25, 26 in parts inside the insertion portion 12 and more on an outer peripheral side than the first and second insertion holes 16, 17. Each shield insertion hole 25, 26 penetrates through the fixing portion 11 in the vertical direction. The shield insertion hole 25 is in the form of a slit extending along a base end of the insulation wall 21 on an outer peripheral side of the insulation wall 21, and the shield insertion hole 26 is in the form of a slit extending along a base end of the insulation wall 23 on an outer peripheral side of the insulation wall 23. Further, if the housing 10 is viewed from below, the shield insertion holes 25, 26 extend along the outer shape of the upper end of the assembly supporting portion 15. The outer peripheral surface of the assembly supporting portion 15 and outer side surfaces of the insulation walls 21, 23 are continuous via the inner peripheral surfaces of the shield insertion holes 25, 26.

A shield 41 is mounted on the housing 10. The shield 41 is made of a metal plate material and has a substantially tubular shape. The shield 41 is composed of a pair of shield body portions 42 to be inserted into the insertion portion 12 and the shield insertion holes 25, 26 and a shield fixing portion 43 for fixing the shield 41 to the housing 10. When viewed from above, the pair of shield body portions 42 are U-shaped to extend along the inner peripheral surfaces of the pair of shield insertion holes 25, 26. The pair of shield body portions 42 are inserted into the insertion portion 12 through the corresponding shield insertion holes 25, 26, and arranged along the insulation walls 21, 23 on the outer peripheral sides of the insulation walls 21, 23 inside the insertion portion 12.

The shield fixing portion 43 is integrally provided to lower end parts of the pair of shield body portions 42. The shield fixing portion 43 has a rectangular tube shape along the outer peripheral surface of the assembly supporting portion 15 and is externally fit to the assembly supporting portion 15. Further, the shield fixing portion 43 includes a plurality of spring contact portions 44. Each spring contact portion 44 functions to cause a shield current to flow by contacting a side surface of the housing 3 when the terminal block 1 is mounted on the casing 3 of the device 2 such as an inverter.

Further, as shown in FIGS. 2 and 4, the housing 10 includes assembly fixing portions 27 for fixing the busbar assembly 50 to the housing 10. In this embodiment, two assembly fixing portions 27 are respectively provided on both side surfaces in the lateral direction of the assembly supporting portion 15 and have the same shape. The two assembly fixing portions 27 are provided at positions below the shield 41 (shield fixing portion 43) in the assembly supporting portion 15.

The assembly fixing portion 27 provided on the left side surface of the assembly supporting portion 15 is a ridge projecting leftward from the left side surface and extending in the front-rear direction. Similarly, the assembly fixing portion 27 (not shown in FIGS. 2 and 4) provided on the right side surface of the assembly supporting portion 15 is a ridge projecting rightward from the right side surface and extending in the front-rear direction. A contact surface 27*a* in the form of a flat surface orthogonal to the vertical direction is provided on the upper end of each assembly fixing portion 27. Further, a guiding portion 27*b* having a lateral projection amount from the side surface of the assembly supporting portion 15 reduced toward a lower side is formed on a lower end part of each assembly fixing portion 27. The two assembly fixing portions 27 are provided at the same position in the vertical direction and front-rear direction in the assembly supporting portion 15. Further, the contact surfaces 27*a* of the two assembly fixing portions 27 are located in the same plane.

As shown in FIGS. 1 to 4, the busbar assembly 50 includes the first and second busbars 51, 52 made of a metal plate material and a holding portion 53 for holding these busbars 51, 52. The first and second busbars 51, 52 are formed by press-working a conductive metal plate material and in the form of strips bent at a plurality of positions. Note that although various metals can be used as a metal used for the first and second busbars 51, 52, it is preferred to use copper or aluminum, for example, in terms of conductivity and cost. Further, an alloy containing at least one of copper and aluminum can also be appropriately used as the material of the first and second busbars 51, 52.

A base end part of the first busbar 51 is an inserting end part 51*a* to be inserted into the insertion portion 12 through the first insertion hole 16, and a tip part of the first busbar 51 is a connecting end part 51*b* to be connected to an in-device busbar 5 inside the device 2. Similarly, a base end part of the second busbar 52 is an inserting end part 52*a* to be inserted into the insertion portion 12 through the second insertion hole 17, and a tip part of the second busbar 52 is a connecting end part 52*b* to be connected to another in-device busbar 6 inside the device 2.

The holding portion 53 is made of an insulating resin material. The holding portion 53 holds the first and second busbars 51, 52 with the tip parts (i.e. connecting end parts 51*b*, 52*b*) of the first and second busbars 51, 52 and the base end parts (i.e. inserting end parts 51*a*, 52*a*) of the first and second busbars 51, 52 exposed. Note that the base end parts of the first and second busbars 51, 52 are located on a side to be inserted into the housing 10 with respect to the holding portion 53, and the tip parts of the first and second busbars 51, 52 are located on a side opposite to the base end parts with respect to the holding portion 53. The base end parts of the first and second busbars 51, 52 only have to be located on the side to be inserted into the housing 10 with respect to the holding portion 53, and may be located on parts on the side to be inserted into the housing 10 with the holding portion 53 as a starting point. Similarly, the tip parts of the first and second busbars 51, 52 only have to be located on the side opposite to the base end parts of the first and second busbars 51, 52 with respect to the holding portion 53 and may be located on sections of parts projecting toward the side opposite to the base end parts of the first and second busbars 51, 52 from the holding portion 53 in the first and second busbars 51, 52.

The holding portion 53 includes a holding body portion 54 having a substantially rectangular parallelepiped shape, four extending portions 55 extending upward from an upper end part of the holding body portion 54, and assembly-side fixing portions 56 integrally provided to the holding body portion 54. The holding portion 53 of this embodiment is integrally molded to the first and second busbars 51, 52.

Both side surfaces in the lateral direction of the holding body portion 54 are parallel to the front-rear direction and vertical direction, and both side surfaces in the front-rear direction are parallel to the lateral direction and the vertical direction. In the holding body portion 54, a part of the first busbar 51 between the inserting end part 51*a* and the connecting end part 51*b* is embedded and held and a part of the second busbar 52 between the inserting end part 52*a* and the connecting end part 52*b* is embedded and held.

Figure 5:
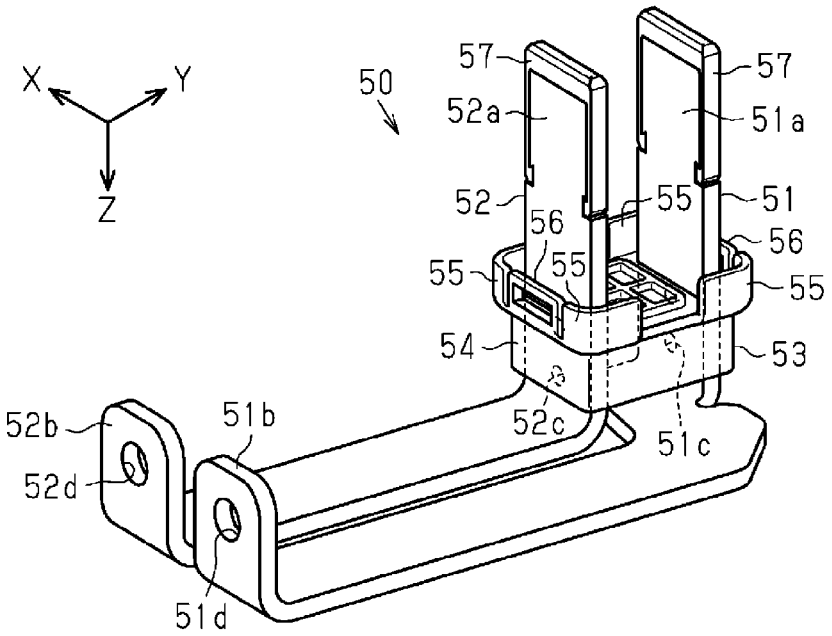
FIG. 5 is a perspective view of a busbar assembly in the one embodiment.

As shown in FIG. 5, the first busbar 51 is provided with a retaining hole 51*c* in the part held in the holding body portion 54, and the second busbar 52 is provided with a retaining hole 52*c* in the part held in the holding body portion 54. The resin material constituting the holding body portion 54 is filled in each retaining hole 51*c*, 52*c*. Thus, relative movements of the first and second busbars 51, 52 and the holding body portion 54 (holding portion 53) are hindered by the retaining holes 51*c*, 52 and the resin material filled into the retaining holes 51*c*, 52*c*.

As shown in FIGS. 1 to 4, the four extending portions 55 respectively extend upward from four corner parts in an upper end part of the holding body portion 54. Each extending portion 55 has an L shape along the corner part of the holding body portion 54 when viewed from above.

Two assembly-side fixing portions 56 are respectively provided on both ends in the lateral direction of the holding body portion 54 and have the same shape. The assembly-side fixing portion 56 provided on a left end part of the holding body portion 54 extends upward from the holding body portion 54 between two extending portions 55 on a left side. Similarly, the assembly-side fixing portion 56 provided on a right end part of the holding body portion 54 extends upward from the holding body portion 54 between two extending portions 55 on a right side. Each assembly-side fixing portion 56 includes a locking hole 56*a* penetrating therethrough in the lateral direction. A width in the front-rear direction of the locking hole 56*a* is equal to or slightly larger than that of the assembly fixing portion 27 of the housing 10. Further, a width in the vertical direction of the locking hole 56*a* is equal to or slightly larger than that of the assembly fixing portion 27. The inner peripheral surface of the locking hole 56*a* has a contact surface 56*b* in the form of a flat surface orthogonal to the vertical direction and facing down. Each assembly-side fixing portion 56 is resiliently deformable to shift a tip in the lateral direction with respect to a base end.

Such a holding portion 53 holds the first and second busbars 51, 52 separated at a certain distance. That is, the holding portion 53 holds the first and second busbars 51, 52 such that the first and second busbars 51, 52 are at a predetermined distance from each other. Note that the "predetermined distance" is a distance between the first and second busbars 51, 52 if the base end part of the first busbar 51 and the base end part of the second busbar 52 are at such a distance as to be connectable to terminals provided in a connector to be connected to the terminal block 1. The inserting end parts 51*a*, 52*a* projecting upward from the holding body portion 54 are separated in the lateral direction and parallel to each other and the tips thereof are at the same position in the vertical direction. Incidentally, insulation caps 57 made of an insulating resin material are respectively mounted on the tip parts of the first and second busbars 51, 52.

Further, a part (part closer to the connecting end part 51*b* than the holding portion 53) of the first busbar 51 projecting downward from the holding portion 53 is bent to extend rightward after extending downward from the holding portion 53, then extends further rearward than the holding portion 53, and is bent to extend upward after extending further rightward than the holding portion 53. In this embodiment, an upward extending part of the tip part is the connecting end part 51*b* in the first busbar 51. The connecting end part 51*b* is provided with a connection hole 51*d* penetrating through the connecting end part 51*b* in a thickness direction.

Further, a part (part closer to the connecting end part 52*b* than the holding portion 53) of the second busbar 52 projecting downward from the holding portion 53 is bent to extend rightward after extending downward from the holding portion 53, and is bent to extend upward after extending further rightward than the holding portion 53. In this embodiment, an upward extending part of the tip part is the connecting end part 52*b* in the second busbar 52. The connecting end part 52*b* is provided with a connection hole 52*d* penetrating through the connecting end part 52*b* in a thickness direction. Further, a section between the bent parts at two positions in a part of the second busbar 52 closer to a tip side than the holding portion 53 extends in parallel to a section located rightward of the holding portion 53 in a part of the first busbar closer to the tip side than the holding portion 53. Further, in this embodiment, the connecting end part 51*b* of the first busbar 51 and the connecting end part 52*b* of the second busbar 52 are at the same position in the vertical direction and lateral direction with respect to the holding portion 53 and arranged side by side in the front-rear direction. When the busbar assembly 50 is viewed from the vertical direction, the tips of the first and second busbars 51, 52 are located more on the outer peripheral side than the holding portion 53.

Figure 6:
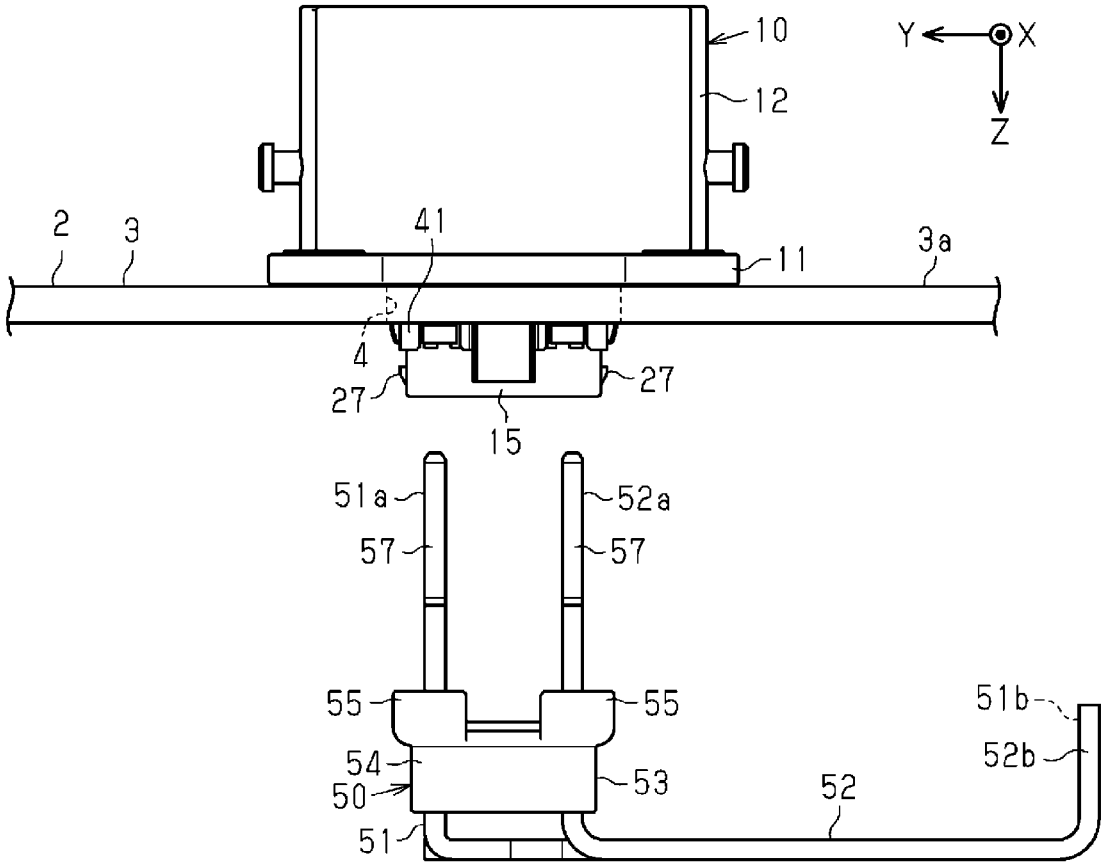
FIG. 6 is a diagram showing a mounting procedure of the terminal block on a casing in the one embodiment.

As shown in FIGS. 1, 4 and 6, when the terminal block 1 is mounted on the casing 3 of the device 2, the housing 10 having the seal member 31 and the shield 41 mounted thereon is first fixed to the casing 3. In particular, the housing 10 is arranged with respect to the casing 3 from outside the casing 3 while the assembly supporting portion 15 is inserted into the mounting hole 4 from outside the casing 3. With the housing 10 arranged with respect to the casing 3, the mounting hole 4 provided in the casing 3 is covered from outside the casing 3 by the fixing portion 11, and the seal body portion 32 of the seal member 31 is in contact with an outer peripheral part of the mounting hole 4 in an outer surface 3*a* of the casing 3. That is, the mounting hole 4 is larger than the assembly supporting portion 15 (outer shape of the assembly supporting portion 15 viewed from the vertical direction) and smaller than the inner peripheral edge of the seal member 31 (inner peripheral edge of the seal body portion 32). Thereafter, unillustrated bolts are inserted into the respective fastening holes 11*a* and nuts are threadably engaged with the bolts, whereby the housing 10 is fixed to the casing 3 (state shown in FIG. 6 is reached). In this way, the seal member 31 is held in close contact with the outer surface 3*a* of the casing 3 and the fixing portion 11 on the outer periphery of the mounting hole 4. Thus, liquid-tight sealing is provided between the outer surface 3*a* of the casing 3*a* and the fixing portion 11 by the seal member 31, wherefore the intrusion of liquid into the casing 3 through the mounting hole 4 is suppressed.

Subsequently, the busbar assembly 50 is fixed to the housing 10 from inside the casing 3. The busbar assembly 50 is inserted into the casing 3 through an opening provided in the casing 3 separately from the mounting hole 4. In fixing the busbar assembly 50 to the housing 10, the inserting end part 51*a* of the first busbar 51 is inserted into the first insertion hole 16 from a lower end side of the assembly supporting portion 15, and the inserting end part 52*a* of the second busbar 52 is inserted into the second insertion hole 17 from the lower end side of the assembly supporting portion 15. Further, if the holding body portion 54 of the holding portion 53 is moved upward toward the lower end part of the assembly supporting portion 15, the lower end part of the assembly supporting portion 15 is inserted inside the four extending portions 55. Simultaneously, as the holding body portion 54 moves, the assembly-side fixing portions 56 are resiliently deformed to shift the tips outward while being guided by the guiding portions 27*b* of the assembly-side fixing portions 27 on the both lateral sides of the assembly supporting portion 15. If the contact surfaces 56*b* of the assembly-side fixing portions 56 move beyond the assembly fixing portions 27, the assembly-side fixing portions 56 are restored and the assembly fixing portions 27 are fit into the locking holes 56*a* of the assembly-side fixing portions 56. By fitting the assembly fixing portions 27 into the locking holes 56*a*, the busbar assembly 50 is fixed to the housing 10. Then, a downward movement of the busbar assembly 50 with respect to the housing 10 is hindered by the contact of the contact surfaces 27*a* of the assembly fixing portions 27 and the contact surfaces 56*b* of the locking holes 56*a*. Further, an upward movement of the busbar assembly 50 with respect to the housing 10 is hindered by the contact of the lower end of the assembly supporting portion 15 and the upper end of the holding body portion 54. Further, movements of the busbar assembly 50 in the front-rear direction and lateral direction with respect to the housing 10 are hindered by the contact of the assembly-side fixing portions 56 and the extending portions 55 with the outer peripheral surface of the assembly supporting portion 15.

Note that the busbar assembly 50 is detachably mountable to the housing 10 because of the holding portion 53 detachably mountable to the housing 10. In this embodiment, after the busbar assembly 50 is fixed to the housing 10, the holding portion 53 is moved in a direction away from the housing 10 with the assembly-side fixing portions 56 resiliently deformed to shift the tips thereof outward and disengage the assembly fixing portions 27 from the locking holes 56*a*, whereby the holding portion 53 can be detached from the housing 10. By detaching the holding portion 53 from the housing 10, the busbar assembly 50 can be detached from the housing 10. Both in a state before the terminal block 1 is mounted on the casing 3 of the device 2 and in a state after the terminal block 1 is mounted on the casing 3 of the device 2, the busbar assembly 50 fixed to the housing 10 can be detached as described above.

As shown in FIGS. 1 and 3, with the busbar assembly 50 fixed to the housing 10, the first and second busbars 51, 52 are passed through the inside of the seal member 31 and also passed through the fixing portion 11. Further, the base end parts, i.e. the inserting end parts 51*a*, 52*a* of the first and second busbars 51, 52 inserted into the insertion portion 12 through the fixing portion 11 extend in parallel to the vertical direction in the insertion portion 12. The inserting end part 51*a* is surrounded by the insulation walls 21, 22 and the inserting end part 52*a* is surrounded by the insulation walls 23, 24. Further, the inserting end parts 51*a*, 52*a* are arranged inside the pair of seal body portions 42. The tips of the first and second busbars 51, 52 are located more on the outer peripheral side than the mounting hole 4 provided in the casing 3 when viewed from a direction parallel to the base end parts (i.e. inserting end parts 51*a*, 51*b*) of the first and second busbars 51, 52 in the insertion portion 12. Note that "when viewed from a direction parallel to the base end parts of the first and second busbars 51, 52 in the insertion portion 12" is synonymous with "when a fixing surface of the housing 10 to be fixed to the casing 3 of the device 2 is viewed from above". The fixing surface is a surface of the fixing portion 11 directly facing the casing 3 when the housing 10 is fixed to the casing 3 and, in this embodiment, is equivalent to the lower surface of the fixing portion 11. The direction parallel to the base end parts of the first and second busbars 51, 52 in the insertion portion 12 is the same as a penetration direction of the mounting hole 4 with the terminal block 1 mounted on the casing 3. Further, the direction parallel to the base end parts of the first and second busbars 51, 52 in the insertion portion 12 is the same as an assembling direction of the busbar assembly 50 with the housing 10 and equivalent to the vertical direction in this embodiment. Further, when viewed from this direction, the tips of the first and second busbars 51, 52 are located more on the outer peripheral side than the inner peripheral edge of the seal member 31 (inner peripheral edge of the seal body portion 32). Further, when viewed from this direction, the tips of the first and second busbars 51, 52 are located more on the outer peripheral side than the assembly supporting portion 15. Furthermore, when viewed from this direction, the tips of the first and second busbars 51, 52 are located more on the outer peripheral side than the fixing portion 11. Further, when viewed from this direction, the tips of the first and second busbars 51, 52 are located more on the outer peripheral side than the housing 10.

As shown in FIG. 3, the in-device busbars 5, 6 are connected to the connecting end parts 51*b*, 52*b* of the first and second busbars 51, 52 of the terminal block 1 mounted on the casing 3 inside the casing 3. A tool for connection is inserted into the casing 3 through the opening provided in the casing 3, and the connecting end part 51*b* of the first busbar 51 and the in-device busbar 5 are connected by being fastened by a bolt 7*a* and a nut 7*b*. At this time, the bolt 7*a* is inserted through the connection hole 51*d* provided in the connecting end part 51*b*. Similarly, the tool for connection is inserted into the casing 3 through the opening, and the connecting end part 52*b* of second busbar 52 and the in-device busbar 6 are connected by being fastened by a bolt 8*a* and a nut 8*b*. At this time, the bolt 8*a* is inserted through the connection hole 52*d* provided in the connecting end part 52*b*.

Functions and effects of this embodiment are described.

(1) The housing 10 to be fixed to the casing 3 of the device 2 and the first and second busbars 51, 52 to be connected to the device inside the casing 3 are separately formed. The first and second busbars 51, 52 are fixed to the housing via the holding portion 53.

For example, in a plurality of types of devices, mounting holes provided in casings of the devices to mount a terminal block have the same shape, but positions inside the casings where a tip part of a busbar and a device-side terminal are connected are different in some cases. In such cases, if the shapes of the first and second busbars 51, 52 of the busbar assembly 50 are changed, the same housing 10 can be used. Further, for example, in a plurality of types of devices, positions inside casings where a tip part of a busbar and a device-side terminal are connected are same, but only the shapes of mounting holes provided in the casings of the devices to mount a terminal block are different in some cases. In such cases, if the shape of the housing 10 is changed, the same busbar assembly 50 can be used. Since various types of devices can be dealt with by combining a housing and a busbar assembly, the number of types of the housings and the busbar assemblies can be reduced as compared to the number of types of conventional terminal blocks in which a terminal and a housing are integrally formed. From these, parts management can be simplified.

(2) Since the first and second busbars 51, 52 are made of the metal plate material, processing is easy. This is preferable in terms of more easily forming the first and second busbars 51, 52 into desired shapes according to the internal configuration of the device 2 to be mounted with the terminal block 1. The first and second busbars 51, 52 are relatively easily processed into complicated shapes. This is more preferable in terms of relaxing restrictions by the shapes of the first and second busbars 51, 52 and the positions of the tips of the first and second busbars 51, 52 and expanding a degree of freedom for the connected positions of the first and second busbars 51, 52 and the in-device busbars 5, 6 on the side of the device 2.

(3) The busbar assembly 50 includes two first and second busbars 51, 52, and the holding portion 53 holds the first and second busbars 51, 52 such that the first and second busbars 51, 52 are at a predetermined distance from each other. Thus, if the busbar assembly 50 includes a plurality of busbars (two first and second busbars 51, 52, in this embodiment), the busbars 51, 52 can be held at a predetermined distance from each other. Therefore, even if the busbar assembly 50 includes the plurality of busbars 51, 52, these busbars 51, 52 are easily handled.

(4) The busbar assembly 50 is detachably mountable to the housing 10 because of the holding portion 53 detachably mountable to the housing 10. Thus, the housing 10 or busbar assembly 50 is more easily replaced according to the configuration of the device 2.

(5) The tips of the first and second busbars 51, 52 are located more on the outer peripheral side than the fixing portion 11 to be fixed to the housing 3 when viewed from the direction parallel to the base end parts (i.e. inserting end parts 51*a*, 51*b*) of the first and second busbars 51, 52 in the insertion portion 12. Thus, the tip parts of the first and second busbars 51, 52 and the in-device busbars 5, 6 may not be connected in a range overlapping the fixing portion 11 in the direction parallel to the base end parts of the first and second busbars 51, 52 in the insertion portion 12 inside the casing 3. This is because it may be difficult to secure a space for connecting tip parts of busbars and connection partners such as in-device busbars depending on the configuration of a device in a range overlapping a housing in a direction parallel to base end parts (end parts arranged outside a casing) inside the casing. However, in this embodiment, the positions where the tip parts of the first and second busbars 51, 52 and the in-device busbars 5, 6 are connected can be set in a wide range outside the fixing portion 11 when viewed from the direction parallel to the base end parts of the first and second busbars 51, 52 in the insertion portion 12 inside the casing 3. Thus, a space required to connect the tip parts of the first and second busbars 51, 52 and the in-device busbars 5, 6 is easily secured. Therefore, restrictions on parts in the device 2 to secure the space required to connect the tip parts of the first and second busbars 51, 52 and the in-device busbars 5, 6 can be suppressed and a degree of freedom in designing the inside of the casing 3 can be improved.

If the terminal block 1 is mounted on the device 2, the housing 10 is arranged with respect to the casing 3 to cover the mounting hole 4 from outside the casing 3. Thus, the fixing portion 11 fixed to the casing 3 is fixed to the outer peripheral part of the mounting hole 4 in the casing 3 and, hence, larger than the mounting hole 4. Therefore, the tips of the first and second busbars 51, 52 located more on the outer peripheral side than the fixing portion 11 when viewed from the direction parallel to the base end parts of the first and second busbars 51, 52 in the insertion portion 12 are located more on the outer peripheral side than the mounting hole 4. The busbar assembly 50 including the first and second busbars 51, 52 is provided separately from the housing 10 to be arranged with respect to the casing 3 from outside the casing 3, and can be fixed to the housing 10 from inside the casing 3. Thus, even if the tips of the first and second busbars 51, 52 are located more on the outer peripheral side than the mounting hole 4 when viewed from the direction parallel to the base end parts of the first and second busbars 51, 52 in the insertion portion 12, the terminal block 1 can be mounted on the casing 3. Accordingly, regardless of the size of the mounting hole 4, the tips of the first and second busbars 51, 52 can be set at desired positions. Therefore, a degree of freedom for the positions of the tips of the first and second busbars 51, 52 inside the casing 3 can be enhanced since the tips of the first and second busbars 51, 52 can be located more on the outer peripheral side than the mounting hole 4 when viewed from the direction parallel to the base end parts of the first and second busbars 51, 52 in the insertion portion 12.

(6) If a busbar is integrally provided to a housing as in a conventional terminal block, the position of the tip of the busbar can be freely set if a mounting hole provided in a casing is enlarged. However, if the mounting hole is enlarged, a circumferential length of a seal member interposed between the housing and the casing also becomes longer. Then, a fastening force for fastening and fixing the housing to the casing needs to be increased to ensure waterproof performance by the seal member. Then, problems such as an increase of a load applied to a fixed part of the housing and the casing and a reduction in assemblability occur. In contrast, in the terminal block 1 of this embodiment, the busbar assembly 50 including the first and second busbars 51, 52 is provided separately from the housing 10 to be arranged with respect to the casing 3 from outside the casing 3, and fixed to the housing 10 from inside the casing 3. Thus, the tips of the first and second busbars 51, 52 can be set at desired positions even without enlarging the mounting hole 4. Therefore, waterproof performance by the seal member 31 can be ensured even without increasing a fastening force in fixing the housing 10 to the casing 3. As a result, the application of a large load to a fixed part of the housing 10 and the casing 3 and a reduction in assemblability can be suppressed.

This embodiment can be modified and carried out as follows. This embodiment and the following modifications can be combined with each other and carried out without technically contradicting each other.

A busbar assembly may include a connector fitting portion, into which in-device connectors provided on end parts of in-device busbars or wires are fittable, on tip parts of busbars.

Figure 7B:
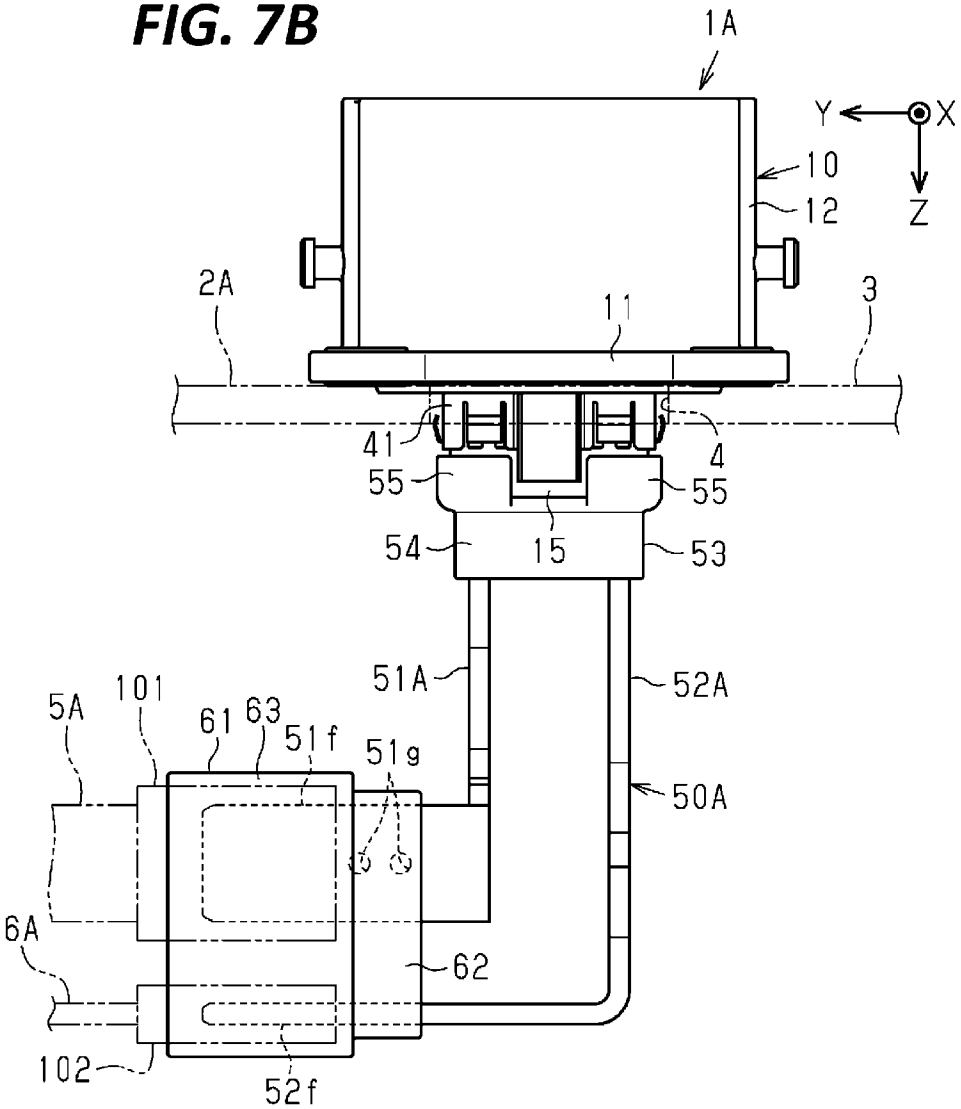
FIG. 7A is a side view of a terminal block in a modification and FIG. 7B is a front view of the terminal block.
Figure 7A:
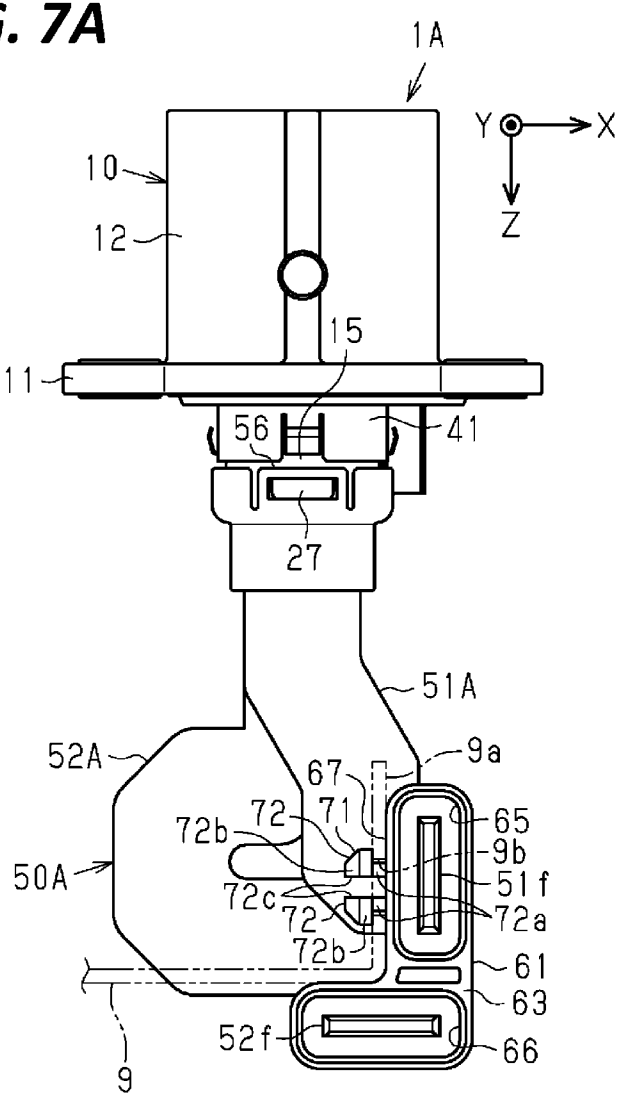
Figure 8:
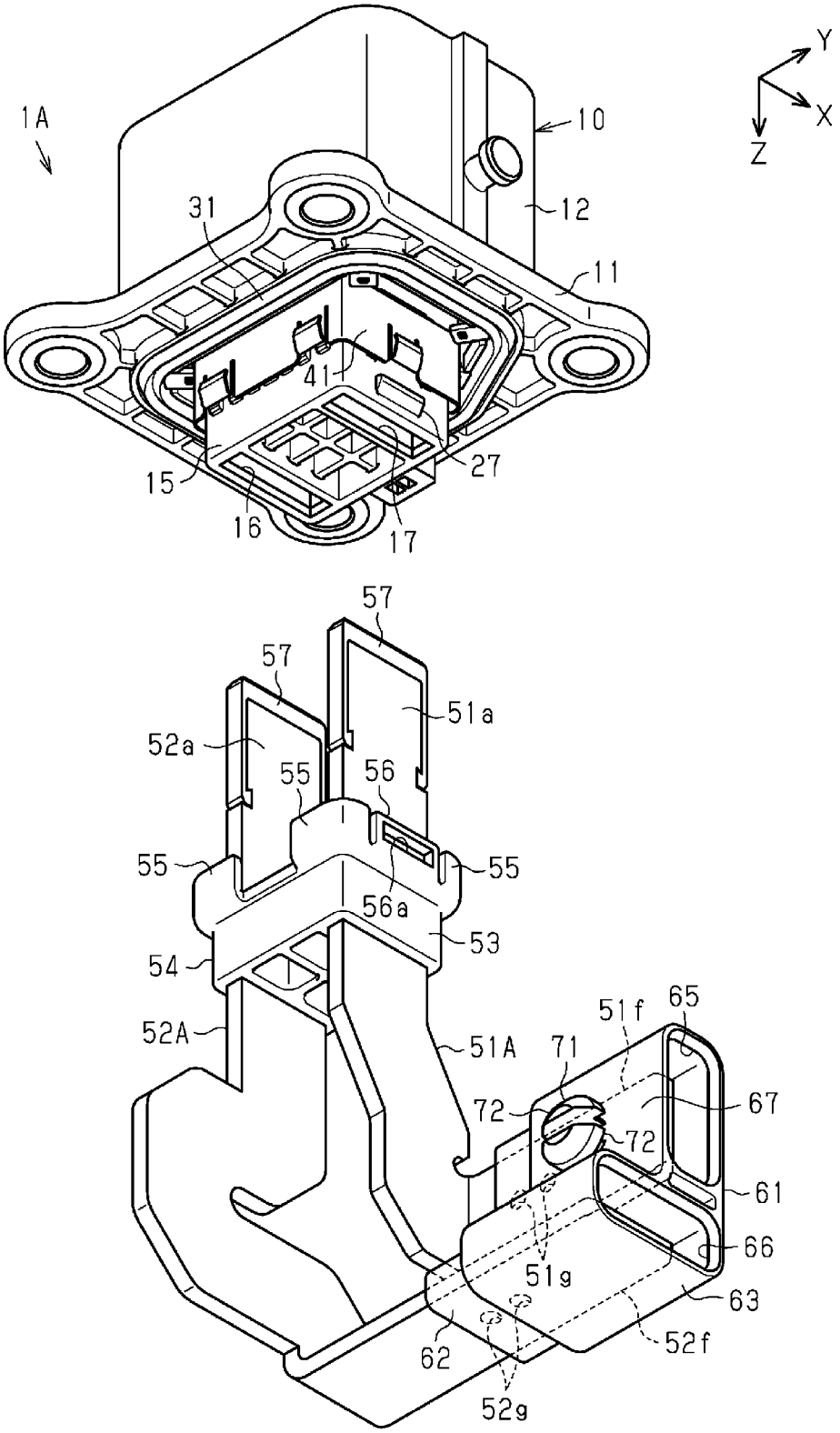
FIG. 8 is an exploded perspective view of the terminal block in the modification.

For example, a terminal block 1A shown in FIGS. 7A, 7B and 8 includes the housing 10 of the above embodiment and a busbar assembly 50A. The busbar assembly 50A includes a holding portion 53, first and second busbars 51A, 52A, and a connector fitting portion 61 provided on tip parts of the first and second busbars 51A, 52A. Note that, in this example, the same or corresponding components as or to those of the above embodiment are denoted by the same reference signs and not described.

A base end part of the first busbar 51A is an inserting end part 51*a* to be inserted into the insertion portion 12, and the tip part of the first busbar 51A is a connecting end part 51*f* to be connected to an in-device busbar 5A inside a device 2A. Further, a base end part of the second busbar 52A is an inserting end part 52*a* to be inserted into the insertion portion 12, and the tip part of the second busbar 52A is a connecting end part 52*f* to be connected to an in-device busbar 6 inside a device 2A.

A part (part closer to the connecting end part 51*f* than the holding portion 53) of the first busbar 51A projecting downward from the holding portion 53 is bent to extend leftward after extending downward while being bent from the holding portion 53 in a plane orthogonal to a lateral direction. Further, a part of the second busbar 52A projecting downward from the holding portion 53 is bent to extend leftward after extending further downward than the tip part of the first busbar 51A while being bent from the holding portion 53 in a plane orthogonal to the lateral direction. Both the connecting end parts 51*f*, 52*f* of the first and second busbars 51A, 52A extend in the lateral direction.

The connector fitting portion 61 is integrally formed to the tip parts (i.e. connecting end parts 51*f*, 52*f*) of the first and second busbars 51A, 52A. The connector fitting portion 61 includes a connector fixing portion 62 for fixing the connector fitting portion 61 to the first and second busbars 51A, 52A and a fit-in portion 63 extending toward the tip sides of the first and second busbars 51A, 52A from the connector fixing portion 62.

Parts of the first and second busbars 51A, 52A between the tips and bent parts are embedded in the connector fixing portion 62. The parts of the first and second busbars 51A, 52A embedded in the connector fixing portion 62 are provided with retaining holes 51*g*, 52*g* penetrating through the busbars 51A, 52A. A movement of the connector fitting portion 61 with respect to the first and second busbars 51A, 52A is suppressed by the entrance of part of a resin material constituting the connector fitting portion 61 into the respective retaining holes 51*g*, 52*g*.

The fit-in portion 63 includes a first fitting recess 65 and a second fitting recess 66 recessed rightward from the tip (left end) of the fit-in portion 63. The connecting end part 51*f* of the first busbar 51A projecting from the connector fixing portion 62 is exposed inside the first fitting recess 65. Further, the connecting end part 52*f* of the second busbar 52A projecting from the connector fixing portion 62 is exposed inside the second fitting recess 65.

Further, the busbar assembly 50A includes a positioning/fixing portion 71 fixable to an in-device fixing portion 9 provided inside the device 2A to be mounted with the terminal block 1A on parts of the first and second busbars 51A, 52A closer to the tip sides than the holding portion 53. In this example, the positioning/fixing portion 71 is integrally provided to the connector fitting portion 61.

A contact surface 67 in the form of a flat surface orthogonal to the lateral direction is provided on the left side surface of the fit-in portion 63 and above the second fitting recess 66 on the outer peripheral surface of the fit-in portion 63. The contact surface 67 is located at a position overlapping the connecting end part 51*f* of the first busbar 51A in the lateral direction. The positioning/fixing portion 71 is composed of a pair of positioning pins 72 projecting from the contact surface 67. The pair of positioning pins 72 are separated in the vertical direction. Each positioning pin 72 includes a shaft portion 72*a* having a semicircular cross-sectional shape and extending leftward from the contact surface 67 and a locking portion 72*b* integrally provided on a tip part of the shaft portion 72*a* and having a larger radius than the shaft portion 72*a*. An inclined surface inclined to reduce the radius of the locking portion 72*b* toward a tip side is provided on an arcuate part of the outer peripheral edge of a tip part of the locking portion 72*b*. Further, facing surfaces 72*c* of the pair of positioning pins 72 facing each other are in the form of flat surfaces orthogonal to the vertical direction. The pair of positioning pins 72 can be resiliently deformed to bring the tips thereof toward each other.

The in-device fixing portion 9 is, for example, a bracket formed by press-working a metal plate material. The in-device fixing portion 9 has a positioning surface 9*a* which can come into contact with the contact surface 67 inside the casing 3. Further, the in-device fixing portion 9 includes a fixing hole 9*b* open in the positioning surface 9*a*. The fixing hole 9*b* is larger in size than the outer peripheries of the shaft portions 72*a* of the pair of positioning pins 72 and smaller than the outer peripheries of the locking portions 72*b* of the pair of positioning pins 72 when viewed from a penetration direction of the fixing hole 9*b*. However, the fixing hole 9*b* is so sized that the two locking portions 72*b* can pass therethrough by the pair of positioning pins 72 being resiliently deformed. Further, in the in-device fixing portion 9, a thickness of an outer peripheral part of the fixing hole 9*b* is substantially equal to a width of a clearance between the contact surface 67 and the locking portions 72*b*.

Such a terminal block 1A is mounted on the casing 3 of the device 2A in a procedure similar to that of the above embodiment. Thereafter, the pair of positioning pins 72 are inserted into the fixing hole 9*b* while being resiliently deformed, whereby the positioning/fixing portion 71 is fixed to the in-device fixing portion 9. The pair of positioning pins 72 are restored when the locking portions 72*b* pass through the fixing hole 9*b*. Then, the contact surface 67 comes into contact with the positioning surface 9*a* and the outer peripheral part of the fixing hole 9*b* in the in-device fixing portion 9 is sandwiched between the contact surface 67 and the locking portions 72*b*. Accordingly, by fixing the positioning/fixing portion 71 to the in-device fixing portion 9, the connector fitting portion 61 is positioned inside the casing 3 and the first and second busbars MA, 52A are positioned inside the casing 3. Note that the tips of the first and second busbars MA, 52A are located more on an outer peripheral side than the fixing portion 11 and further more on the outer peripheral side than the housing 10 when viewed from a direction (i.e. vertical direction) parallel to the base end parts (i.e. inserting end parts M a, Mb) of the first and second busbars MA, 52A in the insertion portion 12.

Thereafter, an in-device connector 101 provided on an end part of the in-device busbar 5A is fit into the first fitting recess 65. The in-device connector 101 includes an unillustrated female terminal electrically connected to the in-device busbar 5A. If the in-device connector 101 is fit into the first fitting recess 65, the connecting end part 51*f* of the first busbar 51A is inserted into the female terminal and the in-device busbar 5A and the first busbar 51A are electrically connected via this female terminal. Similarly, an in-device connector 102 provided on an end part of the in-device busbar 6A is fit into the second fitting recess 66. The in-device connector 102 includes an unillustrated female terminal electrically connected to the in-device busbar 6A. If the in-device connector 102 is fit into the second fitting recess 66, the connecting end part 52*f* of the second busbar 52A is inserted into the female terminal and the in-device busbar 6A and the second busbar 52A are electrically connected via this female terminal.

With this arrangement, the positioning/fixing portion 71 is fixed to the in-device fixing portion 9, whereby the positions of the first and second busbars 51A, 52A are more easily determined in the casing 3. Accordingly, positional variations of the tip parts of the first and second busbars 51A, 52A when the terminal block 1A is mounted on the casing 3 can be suppressed. Further, the vibration of the first and second busbars 51A, 52A inside the casing 3 can be suppressed. Further, if the first and second busbars 51A, 52A and the in-device busbars 5A, 6A are connected after the positioning/fixing portion 71 is fixed to the in-device fixing portion 9, the first and second busbars 51A, 52A and the in-device busbars 5A, 6A can be connected with position shifts of the tip parts of the first and second busbars 51A, 52A suppressed. Therefore, the first and second busbars 51A, 52A and the in-device busbars 5A, 6A can be more easily connected.

Further, since the first and second busbars 51A, 52A are made of the metal plate material, the connector fitting portion 61 can be easily provided on the tip parts of the first and second busbars 51A, 52A. The in-device busbars 5A, 6A and the first and second busbars 51A, 52A are electrically connected by fitting the in-device connectors 101, 102 into the connector fitting portion 61. Thus, the in-device busbars 5A, 6A and the first and second busbars 51A, 52A can be easily connected. Further, the in-device busbars 5A, 6A and the first and second busbars 51A, 52A can be easily connected even without using a tool.

Note that the positioning/fixing portion 71 may be fixed to the in-device fixing portion 9 after the in-device connectors 101, 102 are inserted into the first and second fitting recesses 65, 66. Also by this arrangement, the vibration of the first and second busbars 51A, 52A inside the casing 3 can be suppressed.

Further, the in-device fixing portion 9 may be integrally provided to a component in the device 2 without being limited to the component singly provided and to be fixed inside the casing 3. Further, the shape of the positioning/fixing portion 71 is not limited to the above shape. The positioning/fixing portion 71 may be shaped to be fixable to the in-device fixing portion 9 in the casing 3. For example, the in-device fixing portion 9 may include a fixing pin and the positioning/fixing portion 71 may include a hole into which the fixing pin is to be press-fit.

Further, the connector fitting portion 61 may be provided separately from the first and second busbars 51A, 52A and assembled with the first and second busbars 51A, 52A.

Further, although the positioning/fixing portion 71 is integrally provided to the connector fitting portion 61 in the above busbar assembly 50A, the connector fitting portion 61 and the positioning/fixing portion 71 may be separately provided. Further, the busbar assembly 50A may not necessarily include the connector fitting portion 61. In this case, the positioning/fixing portion 71 is provided on the first or second busbar 51A, 52A by integral molding or assembling. Further, the busbar assembly 50A may not necessarily include the positioning/fixing portion 71.

Further, in the busbar assembly 50A, the in-device connector 101 to be connected to the first busbar 51A and the in-device connector 102 to be connected to the second busbar 52A are fit into one connector fitting portion 61. However, a connector fitting portion provided on the tip part of the first busbar 51A and a connector fitting portion provided on the tip part of the second busbar 52A may be separately provided.

Further, the in-device connectors 101, 102 may be provided on end parts of wires in a device instead of the in-device busbars 5A, 6A.

In the above embodiment, the tips of the first and second busbars 51, 52 are located more on the outer peripheral side than the fixing portion 11 when viewed from the direction parallel to the base end parts of the first and second busbars 51, 52 in the insertion portion 12. However, the positions of the tips of the first and second busbars 51, 52 when viewed from this direction are not limited to these positions. For example, the tips of the first and second busbars 51, 52 may be located inwardly of the mounting hole 4 when viewed from this direction. Even with this arrangement, functions and effects similar to those of (1) of the above embodiment can be obtained.

For example, the tips of the first and second busbars 51, 52 may be located more on the outer peripheral side than the mounting hole 4 and more on an inner peripheral side than the inner peripheral edge of the seal member 31 (inner peripheral edge of the seal body portion 32) when viewed from this direction. Further, the tips of the first and second busbars 51, 52 may be, for example, located more on the outer peripheral side than the seal member 31 and inwardly of the outer peripheral edge of the fixing portion 11 when viewed from this direction. Even with this arrangement, functions and effects similar to those of the above embodiment can be obtained.

In the above embodiment, the first and second busbars 51, 52 include the retaining holes 51*c*, 52*c*. However, the parts of the first and second busbars 51, 52 to be embedded in the holding portion 53 may include notches instead of the retaining holes 51*c*, 52*c*. This notch is provided in at least one end part in a width direction of each busbar 51, 52 and recessed toward a widthwise center and penetrates through each busbar 51, 52 in the thickness direction. Even with this arrangement, the resin material constituting the holding portion 53 enters the notches, whereby a movement of the holding portion 53 with respect to the first and second busbars 51, 52 can be suppressed. Further, the first and second busbars 51, 52 may include, for example, retaining recesses recessed in the thickness direction of the busbars 51, 52 instead of the retaining holes 51*c*, 52*c*. Even with this arrangement, the resin material constituting the holding portion 53 enters the retaining recesses, whereby a movement of the holding portion 53 with respect to the first and second busbars 51, 52 can be suppressed. Note that the first and second busbars 51, 52 may not necessarily include the retaining holes 51*c*, 52*c*, the notches or the retaining recesses.

In the above embodiment, the busbar assembly 50 is detachably mountable to the housing 10 because of the holding portion 53 detachably mountable to the housing 10 both in the state before the terminal block 1 is mounted on the casing 3 of the device 2 and in the state after the terminal block 1 is mounted. However, the busbar assembly 50 only has to be detachably mountable to the housing 10 because of the holding portion 53 detachably mountable to the housing 10 at least in the state before the terminal block 1 is mounted on the casing 3 of the device 2. That is, the busbar assembly 50 may be completely (i.e. undetachably) fixed to the housing 10 after the terminal block 1 is mounted on the casing 3 of the device 2. Note that the busbar assembly 50 may be configured to be undetachable once being fixed to the housing 10 if the busbar assembly 50 needs not be fixed to the housing 10 in the state before the terminal block 1 is mounted on the casing 3 of the device 2.

In the above embodiment, the holding portion 53 is integrally molded to the first and second busbars 51, 52. However, the configuration of the holding portion 53 for holding the first and second busbars 51, 52 is not limited to this. For example, the holding portion 53 may be composed of two components to be assembled with each other, one component is integrally molded to the first busbar 51 and the other component may be integrally molded to the second busbar 52. Further, the holding portion 53 may be, for example, formed separately from the first and second busbars 51, 52. In this case, the holding portion 53 is, for example, divided into a plurality of pieces and these pieces are assembled with the first and second busbars 51, 52. Further, in this case, constituent components of the holding portion 53 to be assembled with the first busbar 51 and those of the holding portion 53 to be assembled with the second busbar 52 may be separate.

In the above embodiment, the busbar assembly 50 includes two first and second busbars 51, 52. However, the number of the busbars provided in the busbar assembly 50 is not limited to two and may be any number equal to or greater than 1.

In the above embodiment, the first and second busbars 51, 52 are made of the metal plate material. However, the material of the first and second busbars 51, 52 is not limited to the metal plate material as long as the first and second busbars 51, 52 are made of metal. For example, the first and second busbars 51, 52 may be cylindrical round pins made of metal.

In the above embodiment, the busbar assembly 50 is fixed to the housing 10 by the assembly fixing portions 27 of the housing 10 being fit into the assembly-side fixing portions 56 of the busbar assembly 50. The numbers and positions of the assembly-side fixing portions 56 and the assembly fixing portions 27 may be changed as appropriate. Further, the structure for fixing the busbar assembly 50 to the housing 10 is not limited to this. For example, the housing 10 may be provided with the assembly-side fixing portions 56 of the above embodiment and the holding portion 53 of the busbar assembly 50 may be provided with the assembly fixing portions 27 of the above embodiment. Further, the holding portion 53 may be, for example, fastened and fixed to the housing 10 by screws or the like.

The shape of the housing 10, the shapes of the first and second busbars 51, 52 and the shape of the holding portion 53 are not limited to those of the above embodiment and may be changed as appropriate according to the shape of the casing 3 of the device 2 to be mounted with the terminal block 1.

Technical concepts which can be grasped from the above embodiment and modifications are described.

(A) The terminal block of any one of claims 1 to 7 in which the tip of the busbar is located more on the outer peripheral side than the housing when viewed from the direction parallel to the base end part of the busbar.

According to this configuration, the tip part of the busbar and a device-side terminal may not be connected in a range overlapping the housing in the direction parallel to the base end part of the busbar inside the casing. Since a position where the tip part of the busbar and the device-side terminal are connected can be set in a wide range outside the housing when viewed from the direction parallel to the base end part of the busbar inside the casing, a space required to connect the tip part of the busbar and the device-side terminal is easily secured. Therefore, restrictions on parts in the device to secure the space required to connect the tip part of the busbar and the device-side busbar can be suppressed and a degree of freedom in designing the inside of the casing can be improved.

If the terminal block is mounted on the device, the housing is arranged with respect to the casing to cover the mounting hole provided in the casing to mount the terminal block from outside the casing. Thus, the housing is larger than the mounting hole. Therefore, the tip of the busbar located more on the outer peripheral side than the housing when viewed from the direction parallel to the base end part of the busbar is located more on the outer peripheral side than the mounting hole. The busbar assembly including the busbar is provided separately from the housing to be arranged with respect to the casing from outside the casing, and can be fixed to the housing from inside the casing. Thus, even if the tip of the busbar is located more on the outer peripheral side than the mounting hole when viewed from the direction parallel to the base end part of the busbar, the terminal block can be mounted on the casing. Accordingly, regardless of the size of the mounting hole, the tip of the busbar can be set at a desired position. Therefore, a degree of freedom for the position of the tip of the busbar inside the casing can be enhanced since the tip of the busbar can be located more on the outer peripheral side than the mounting hole when viewed from the direction parallel to the base end part of the busbar.

(B) The terminal block of any one of claims 1 to 4 in which the housing includes the fixing portion to be fixed to the casing of the device and the insertion portion projecting from the fixing portion, the base end part of the busbar passed through the fixing portion being inserted into the insertion portion, the annular seal member is provided to seal between the device and the fixing portion by being mounted on the fixing portion, the busbar is passed through the inside of the seal member, and the tip of the busbar is located more on the outer peripheral side than the inner peripheral edge of the seal member when viewed from the direction parallel to the base end part of the busbar in the insertion portion.

According to this configuration, the tip part of the busbar and the device-side terminal may not be connected in a range overlapping a range inwardly of the inner peripheral edge of the seal member in the direction parallel to the base end part of the busbar in the insertion portion inside the casing. Since the position where the tip part of the busbar and the device-side terminal are connected can be set in a wide range outside the inner peripheral edge of the seal member when viewed from the direction parallel to the base end part of the busbar in the insertion portion inside the casing, the space required to connect the tip part of the busbar and the device-side terminal is easily secured. Therefore, restrictions on the parts in the device to secure the space required to connect the tip part of the busbar and the device-side busbar can be suppressed and a degree of freedom in designing the inside of the casing can be improved.

Further, the mounting hole provided in the casing of the device to mount the terminal block is generally smaller than the inner peripheral edge of the seal member. Accordingly, the tip of the busbar located more on the outer peripheral side than the inner peripheral edge of the seal member when viewed from the direction parallel to the base end part of the busbar in the insertion portion is located more on the outer peripheral side than the mounting hole. The busbar assembly including the busbar is provided separately from the housing to be arranged with respect to the casing from outside the casing, and can be fixed to the housing from inside the casing. Thus, even if the tip of the busbar is located more on the outer peripheral side than the mounting hole when viewed from the direction parallel to the base end part of the busbar in the insertion portion, the terminal block can be mounted on the casing. Accordingly, regardless of the size of the mounting hole, the tip of the busbar can be set at a desired position. Thus, the tip of the busbar can be located more on the outer peripheral side than the mounting hole when viewed from the direction parallel to the base end part of the busbar in the insertion portion, wherefore a degree of freedom for the position of the tip of the busbar inside the casing can be enhanced.

LIST OF REFERENCE NUMERALS

1, 1A . . . terminal block
2, 2A . . . device
3 . . . casing
5A, 6A . . . in-device busbar
9 . . . in-device fixing portion
10 . . . housing
11 . . . fixing portion
12 . . . insertion portion
50, 50A . . . busbar assembly
51, 51A . . . first busbar (busbar)
52, 52A . . . second busbar (busbar)
53 . . . holding portion
61 . . . connector fitting portion
71 . . . positioning/fixing portion
101, 102 . . . in-device connector

What is claimed is:

1. A terminal block, comprising:
a busbar assembly including a busbar made of metal and a holding portion for holding the busbar, a tip part and a base end part of the busbar being exposed; and
a housing, the base end part of the busbar being inserted into the housing, the holding portion being fixed to the housing,
wherein:
the busbar linearly penetrates through the holding portion in a first direction in which the holding portion is coupled to the housing, and
the holding portion is engaged with the housing to fix the busbar assembly to the housing and the base end part of the busbar linearly extends in the first direction inside the housing when the busbar assembly is linearly inserted into the housing in the first direction.

2. The terminal block of claim 1, wherein the busbar is made of a metal plate material.

3. The terminal block of claim 1, wherein:
the busbar assembly includes first and second busbars, and
the holding portion holds the first and second busbars such that the first and second busbars are at a predetermined distance from each other.

4. The terminal block of claim 1, wherein the holding portion is detachably mountable to the housing such that the busbar assembly is detachably mountable to the housing.

5. The terminal block of claim 1, wherein:
the housing includes a fixing portion to be fixed to a casing of a device and an insertion portion projecting from the fixing portion, the base end part of the busbar passed through the fixing portion being inserted into the insertion portion, and a tip of the busbar is located more on an outer peripheral side than the fixing portion when viewed from a direction parallel to the base end part of the busbar in the insertion portion.

6. The terminal block of claim 1, wherein the busbar assembly includes a positioning/fixing portion fixable to an in-device fixing portion provided inside a device to be mounted with the terminal block in a part of the busbar closer to a tip side than the holding portion.

7. The terminal block of claim 1, wherein:

the busbar assembly includes a connector fitting portion provided on the tip part of the busbar, an in-device connector provided on an end part of an in-device busbar or wire to be connected to the busbar being fittable into the connector fitting portion, and the busbar is electrically connected to the in-device busbar or wire via the in-device connector fit in the connector fitting portion.

8. The terminal block of claim 1, wherein the housing is detachably mountable to a casing of a device such that the terminal block is detachably mountable to the casing.

9. The terminal block of claim 1, wherein the tip part of the busbar and an in-device busbar are connected by being fastened by fasteners.

* * * * *